United States Patent [19]

Miller

[11] 4,172,488

[45] Oct. 30, 1979

[54] FLASKLESS MOLDING LINE FOR CHEMICALLY BONDED SAND MOLDS

[75] Inventor: Charles R. Miller, Bedford, Ohio

[73] Assignee: Combustion Engineering, Inc., Windsor, Conn.

[21] Appl. No.: 898,587

[22] Filed: Apr. 21, 1978

[51] Int. Cl.[2] ..... B22C 11/02; B22C 17/08

[52] U.S. Cl. ..... 164/181; 164/185; 164/189; 164/223; 164/224; 164/409

[58] Field of Search ..... 164/29, 137, 168, 181, 164/185, 189, 205, 223, 224, 339, 409

[56] References Cited

U.S. PATENT DOCUMENTS

| | | | |
|---|---|---|---|
| 2,652,606 | 9/1953 | Mezger | 164/189 |
| 2,652,608 | 9/1953 | Mezger | 164/409 X |
| 4,124,126 | 11/1978 | Abraham | 164/224 X |

FOREIGN PATENT DOCUMENTS

| | | | |
|---|---|---|---|
| 861126 | 2/1961 | United Kingdom | 164/339 |

*Primary Examiner*—Robert D. Baldwin
*Assistant Examiner*—J. Reed Batten, Jr.
*Attorney, Agent, or Firm*—Robert L. Olson

[57] ABSTRACT

A system for automatically forming flaskless sand molds, and preparing them for metal pouring. Cope and drag flasks are alternately filled with chemically bonded sand on an indexing turntable, and the sand is allowed to cure or set up while still on the turntable. The copes and drags are then automatically removed from their respective flasks and placed on a conveyor belt by a roll-over draw machine. The above is accomplished automatically, with little or no supervision required.

4 Claims, 7 Drawing Figures

FLASKLESS MOLDING LINE FOR CHEMICALLY BONDED SAND MOLDS

BACKGROUND OF THE INVENTION

The method of forming flaskless molds automatically has been practiced for some time. The economic advantages have long been recognized. Most systems in existence today have some shortcomings, however. Either the quality of the finished molds is poor, the system is too complicated, or the production rate is low.

SUMMARY OF THE INVENTION

The flaskless molding line of the present invention can produce high quality finished, copes and drags at rates of up to 100 per hour of each. Cope and drag flasks are alternately filled with chemically bonded sand on an indexing turntable. A rollover draw machine removes the mold halves from the turntable and deposits them free of their flasks, on a conveyor belt.

DESCRIPTION OF THE PREFERRED EMBODIMENT

Figure 1:
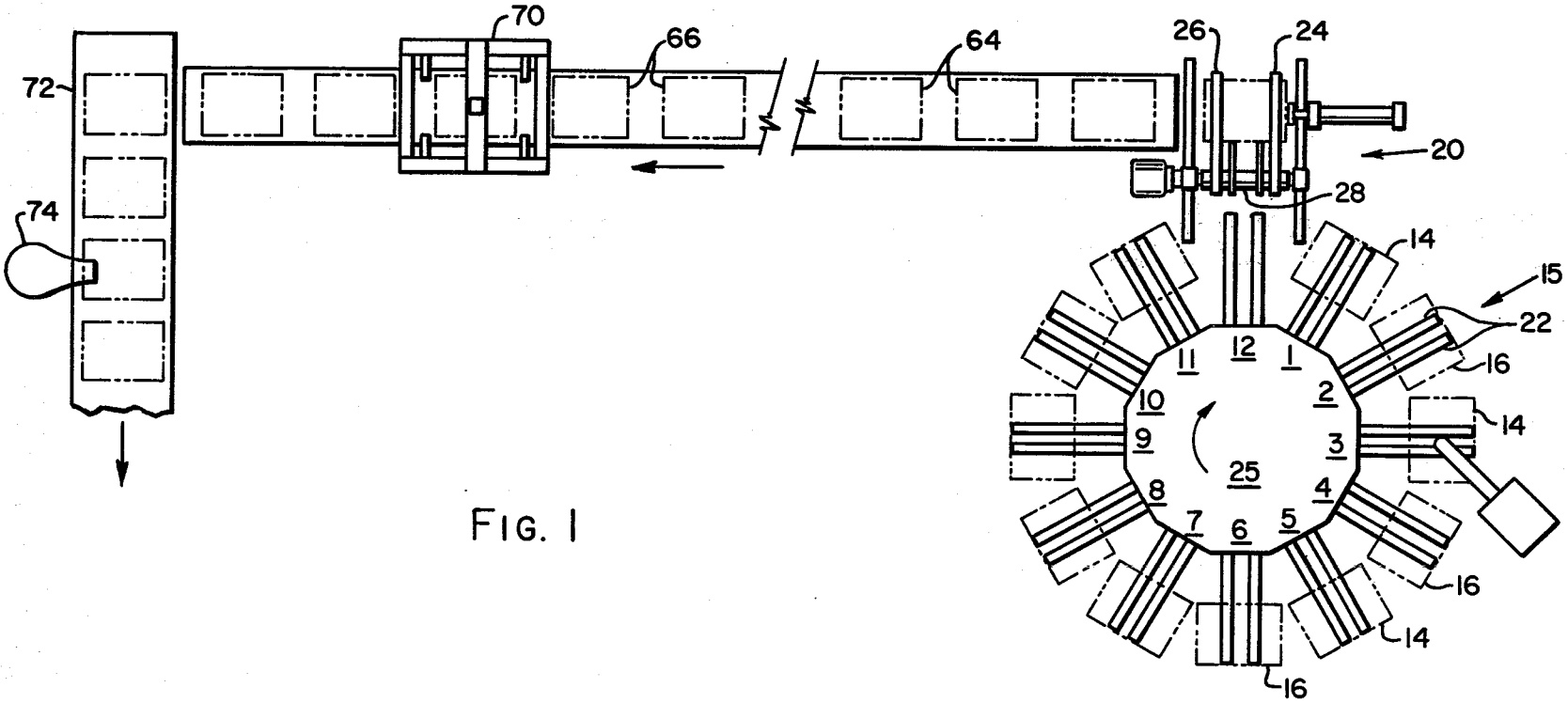
FIG. 1 is a plan view of the mold-making assembly.
Figure 2:
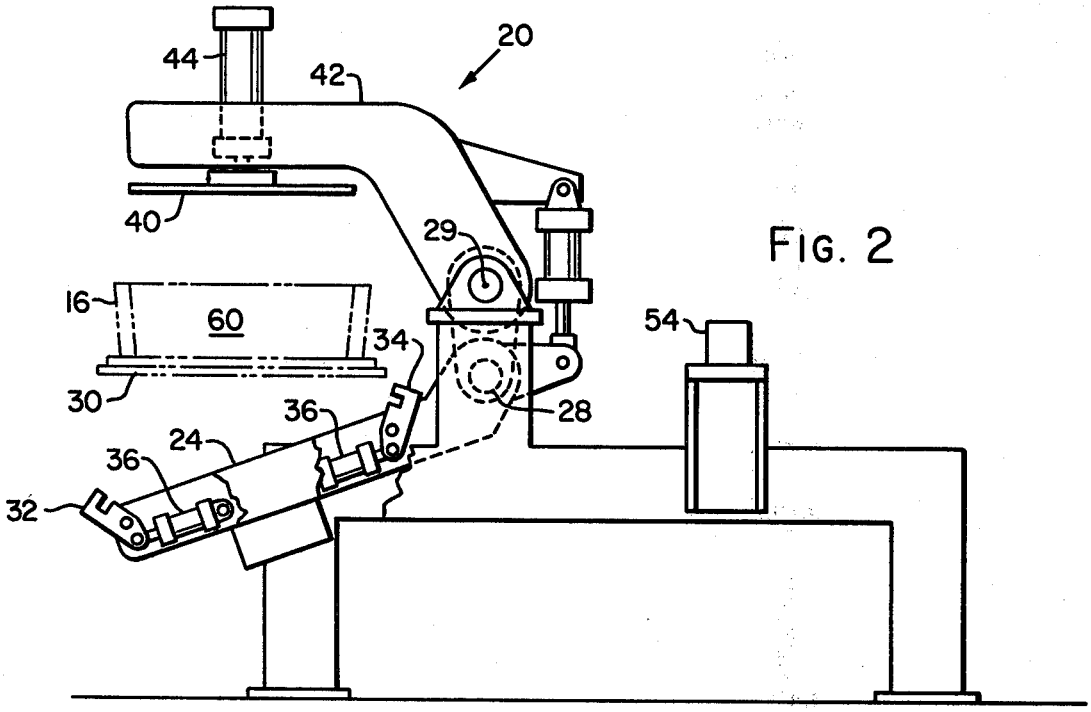
FIG. 2 is a side view of the rollover draw machine.

Looking now to FIG. 1, numeral 15 designates an indexing turntable having twelve stations, numbered 1–12 respectively. An indexing motor rotates the table 30 degrees, for example every eighteen seconds. At stations 1 and 2, an operator can remove and replace the flasks with ones of differently configured patterns or sizes, if such is desired. The cope and drag flasks are alternated, with every other one being a cope flask 14 with a drag flask 16 located therebetween. All of the flasks have an integral pattern secured in the bottom thereof. At station 3, the flasks are filled with chemically bonded sand, in any of several well-known manners. From stations 4 through 11, the sand is allowed to set up or harden. Thus, with a turntable that indexes every eighteen seconds, approximately two and one half minutes are allowed for the sand to cure.

At station 12, the flask, containing either a cope or a drag therein is removed from the turntable by means of the rollover draw machine 20. The flasks, in being indexed about the turntable 15, are carried on a pair of tines 22, which are supported by and extend from the central hub or table 25.

Looking now to FIGS. 2–7, the rollover draw machine 20 will be described in more detail. When the turntable indexes a flask onto station 12, a pair of lower arms 24 and 26 (FIG. 1) rotate about axis 28 in an upward direction, until they reach a point directly beneath the bolster 30, which is integral with the flask 16. At this time, a pair of grippers 32 and 34, carried on arm 24, are actuated by piston-cylinder member 36 so as to grip the bolster. Arm 26 carries an additional pair of piston-cylinder actuated grippers, which are also actuated at the same time, so the bolster 30 is gripped and held at all four of its corners. It can be seen that any reasonable size flask can be attached to the bolster.

Figure 3:
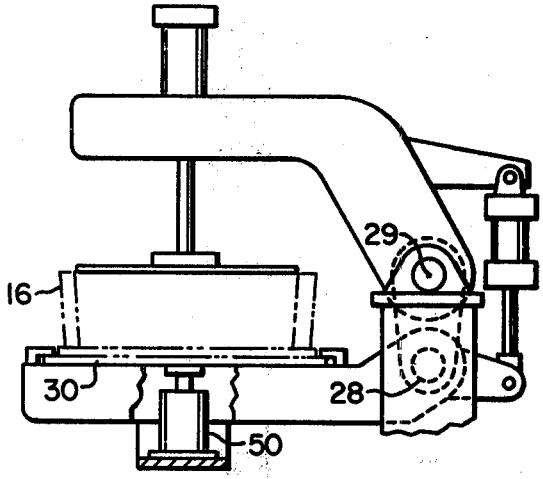
FIGS. 3 through 5 are schematics of the rollover draw machine shown in various working positions.
Figure 4:
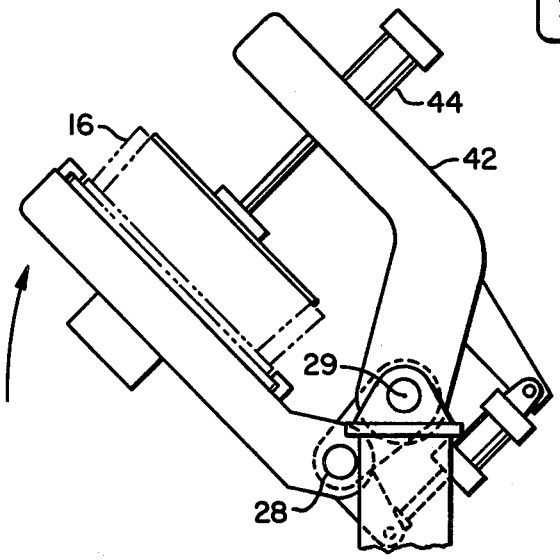
Figure 5:
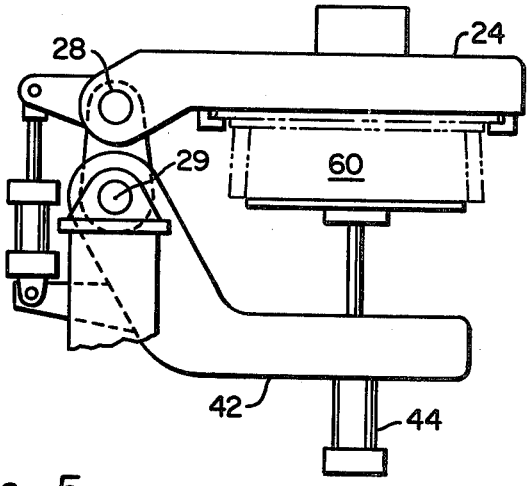
Figure 6:
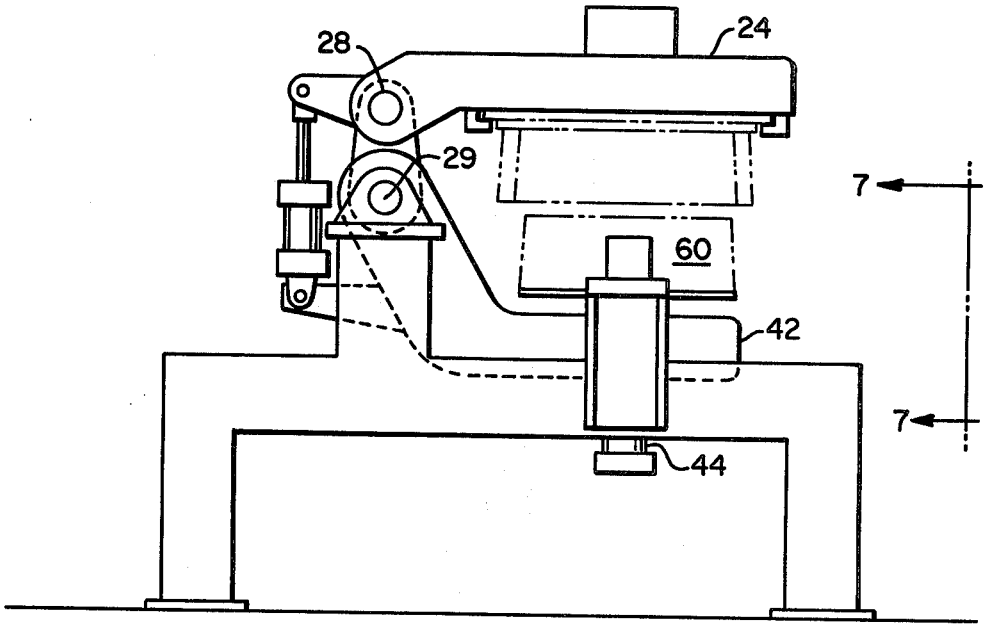
FIG. 6 is a side view of the rollover draw machine after the mold half has been removed from its flask.
Figure 7:
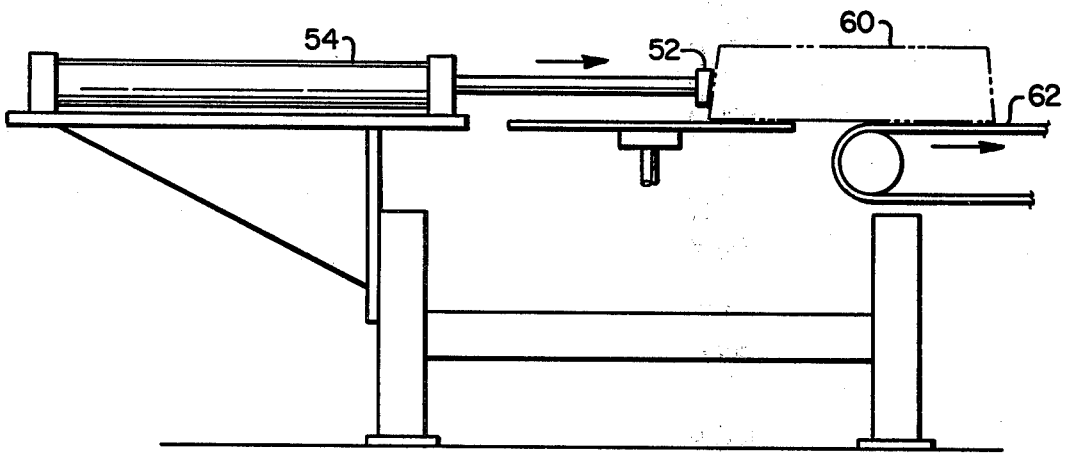
FIG. 7 is a view taken on line 7—7 of FIG. 6.

At the same time arms 24 and 26 are moving up, the draw table 40, carried on arm 42, is moved in a downward direction by a piston-cylinder 44, until it rests on the upper surface of the sand in flask 16, as shown in FIG. 3. At this point in time, all of the arms 24, 26, and 42 start rotating about shaft 29 (FIG. 4) and rotate through a 180 degree arc, so as to turn the flask and mold half completely over, as shown in FIG. 5. After roll-over, two vibrating motors 50, one carried by each of arms 24 and 26, are activated so as to vibrate and loosen the sand mold 60 from its flask. These can be any type of vibrating motors, but preferably are air motors. The sand mold is then supported on the draw table 40, while the flask 16 is held and supported by the four grippers. The draw table 40, carrying the mold half, then is lowered by the piston-cylinder 44 and positions it properly for the mold pusher 52 (FIG. 7). A piston-cylinder 54 then pushes the mold-half off of the draw table 40, onto an indexing conveyor belt 62 (FIGS. 1 and 7).

Thus, the mold halves, first the cope, followed by a drag, then another cope, etc., are deposited with the parting line or pattern side up on the indexing conveyor belt 62. The conveyor belt is also indexed, or moves a given distance, every eighteen seconds, so that its movement coincides with the movement of the turntable. At stations 64 and 66 (FIG. 1), the mold halves can be washed, inspected, and cores set in the drags. At station 70, the copes are assembled onto the drags, thus forming a complete mold, ready for pouring. This machine is described in more detail in my co-pending patent application Ser. No. 898,586 entitled, "Rollover Closer", which was filed on even date herewith. The completed molds are moved onto the conveyor belt 72, and metal is poured at station 74, to complete the casting process.

Thus it can be seen that a system is provided for making and pouring molds in an efficient, reliable, rapid manner, requiring very little personnel supervision. If desired, the cores could be fabricated on the turntable, and then every third unit would be a core, cope and drag. If eighteen second indexing were used, this would reduce production to approximately 65 per hour.

What is claimed is:

1. Apparatus for making sand mold halves including a turntable, means for filling a flask with chemically bonded sand to form a mold half at a first position on the turntable, means for periodically indexing or rotating the turntable a given amount, a rollover draw machine located adjacent to the turntable at a second position, said rollover draw machine having means to grip the flask and rotate it 180° degrees, to a point outside of the turntable, vibrating motor means for loosening the mold half from the flask, conveyor means adjacent the turntable, and means for depositing the loosened mold half onto the conveyor means, the turntable having tines extending radially outwardly therefrom, on which the flask is supported, the flask overhanging the tines on both sides thereof, the rollover draw machine having a pair of spaced arms originally located beneath the tines, each arm containing a pair of spaced gripping means, means for rotating the arms up into contact with the bottom of the flask, means to actuate the gripping means such that they grip the flask at locations adjacent each corner thereof, a plate carried by another arm, which arm is located above the flask, means for actuating the plate so that it moves downwardly until it contacts the sand in the flask, means for thereafter rotating all of the arms 180° degrees, removing the flask from the turntable and turning it upside down.

2. The apparatus set forth in claim 1, wherein each of the spaced arms contain a vibrating motor thereon which contacts the bottom of the flask, for loosening the mold half from the flask, so that it is supported on the plate.

3. Apparatus set forth in claim 2, including means for raising the flask away from the mold half after it has been loosened, and a motor actuated pusher for sliding the mold half off of the plate onto the conveyor means.

4. Apparatus set forth in claim 3, including means for rotating all of the arms back to their original position after the mold half has been placed on the conveyor means, thereby placing the flask onto the turntable again.

* * * * *